US007160080B2

(12) United States Patent
Lin

(10) Patent No.: US 7,160,080 B2
(45) Date of Patent: Jan. 9, 2007

(54) FAN ASSEMBLY

(75) Inventor: Fang-Cheng Lin, Hsin Chuang (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 151 days.

(21) Appl. No.: 10/747,479

(22) Filed: Dec. 25, 2003

(65) Prior Publication Data

US 2005/0141992 A1 Jun. 30, 2005

(51) Int. Cl.
*F04D 29/52* (2006.01)

(52) U.S. Cl. ..... 415/177; 415/220; 416/247 R

(58) Field of Classification Search ..... 416/247 R; 415/177, 176, 220, 186, 185, 183
See application file for complete search history.

(56) References Cited

U.S. PATENT DOCUMENTS

| | | | | |
|---|---|---|---|---|
| 5,615,998 | A * | 4/1997 | Kodama et al. | 415/177 |
| 6,186,739 | B1 * | 2/2001 | Hsieh | 416/244 R |
| 6,407,919 | B1 * | 6/2002 | Chou | 361/697 |
| 6,481,963 | B1 * | 11/2002 | Lin et al. | 415/220 |
| 6,587,341 | B1 * | 7/2003 | Wei | 415/176 |
| 2004/0173339 | A1 * | 9/2004 | Cheng | 165/121 |

* cited by examiner

*Primary Examiner*—Richard A. Edgar

(57) ABSTRACT

A fan frame provides fixing parts extending downward to embrace a radiator with a hook end catching lower side of the radiator respectively. A guard device is disposed on the frame with hard skeletons to surround a fan wheel so that fluid can enter the radiator via the openings. Hence, the openings of the guard device can increase flow rate of the fluid entering the radiator, decrease noise and prevent foreign objects entering the fan wheel.

6 Claims, 9 Drawing Sheets

FAN ASSEMBLY

BACKGROUND OF THE INVENTION

1. Field of the Invention

The present invention relates to a fan device with a fan device with a radiator, and particularly to a fan frame of a cooling fan.

2. Description of Related Art

Due to electronic components being designed to provide higher performance and smaller sizes along with generating more heat, the issued heat intensity increases quickly. As a result, the performance and reliability thereof are influenced and, even more, life span thereof may become shorter if the heat is not removed effectively. Hence, how to dissipate more heat from the electronic components significantly is a great challenge to researchers in the related fields.

Further, it has to be noted that problem of heat dissipation will be an obstacle against development of the electronic components in the future when more electronic components such as integrated circuits (ICs) with much better functions are in running.

The computer is a typical example providing electronic components, which is related to noticeable heat generation. In order to lower down high temperature resulting from operation of the central processing unit, heat dissipation device associated with a fan is most popularly used currently. The concept of design thereof is that the heat dissipation device, which is made of metal such as copper or aluminum with high heat conductive coefficient, is adhered to the surface of an electronic part tightly so that heat generated from the electronic component is dissipated by way of heat conduction and convention with assistance of air blown by the fan to allow the electronic component operating at a constant working temperature. It is known that heat conductive rate of the heat dissipation device depends on the heat transmitting area, that is, a larger area for heat transmission provides better effect of heat dissipation and vice versa. However, host unit of the computer only provides a very limited space for locating the heat dissipation device with the fan. Therefore, how to increase airflow rate dragged by the fan so as to produce much efficient heat convection for removing heat is a key trend being investigated currently.

Further, referring to FIGS. 1 to 3, a conventional fan device includes a fan frame 11 and a fan 12. The fan frame 11 is hollow and provides a frame wall 111 to define a flow channel 115 with an inlet 112 and an outlet 113 at both lateral sides thereof. A hub seat 114 is mounted in the flow channel 115 and the fan 12 has a hub 121 with fan blades 122 extending outward radially from circumference of the hub 121. The fan is rotationally attached to the hub seat 114 for dragging air into the fan from the inlet 112 and the air flows outward via the outlet 113.

However, a problem resided in the preceding conventional device is that only limited air enters the flow channel 115 and radial pressure of the entered air results in creating noise while the air hits the frame wall 111.

SUMMARY OF THE INVENTION

An object of the present invention is to provide a fan frame, which allows the flow rate of the fluid being increased substantially.

Another object of the present invention is to provide a fan frame, which attenuates noise generation.

A further object of the present invention is to provide a fan frame, which prevents foreign objects entering the fan.

BRIEF DESCRIPTION OF THE DRAWINGS

The present invention can be more fully understood in the following description with reference to accompanying drawings, in which.

DETAILED DESCRIPTION OF THE PREFERRED EMBODIMENS

Figure 1:
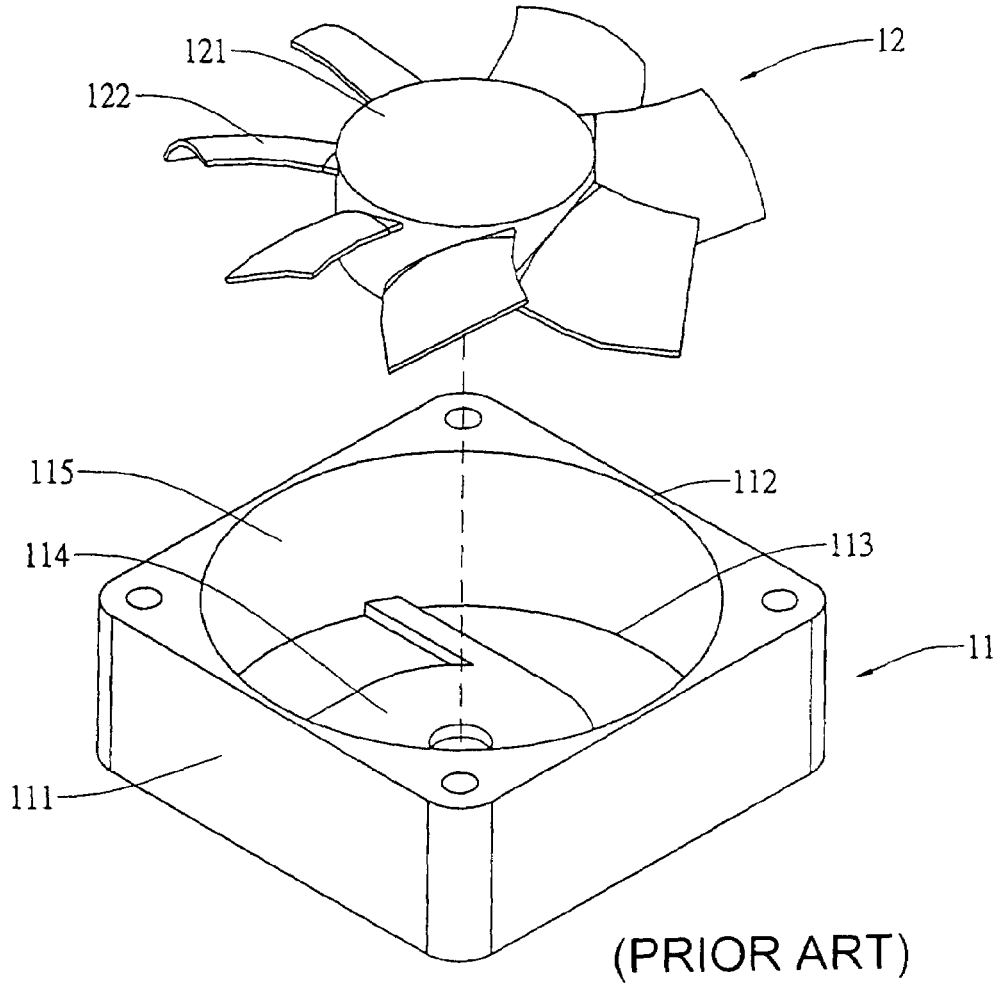
(PRIOR ART) Fig 1
FIG. 1 is a disassembled perspective view of a conventional fan device.
Figure 2:
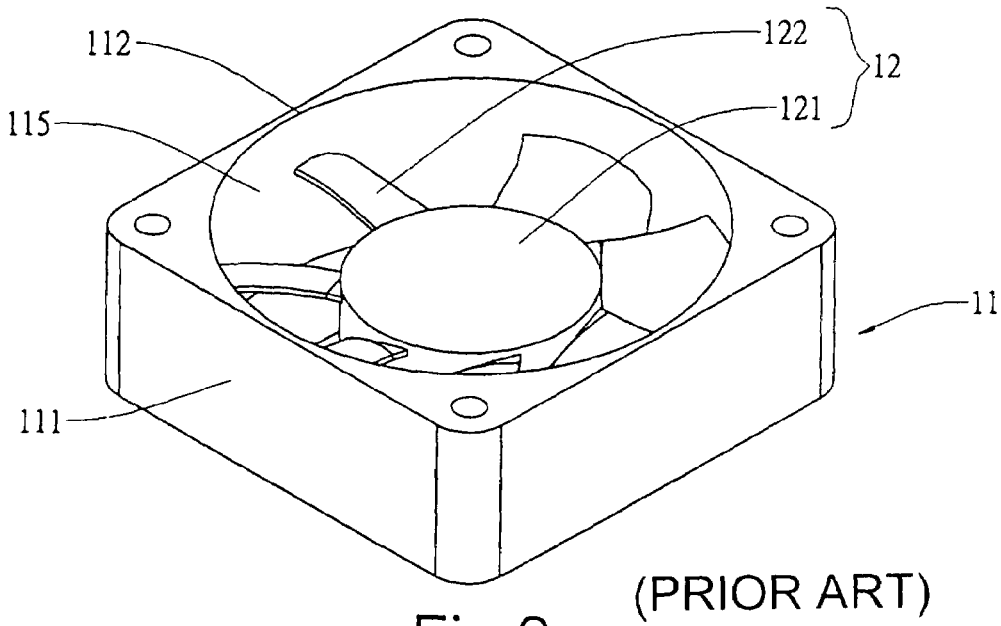
(PRIOR ART) Fig 2
FIG. 2 is an assembled perspective view of the conventional fan device shown in FIG. 1.
Figure 3:
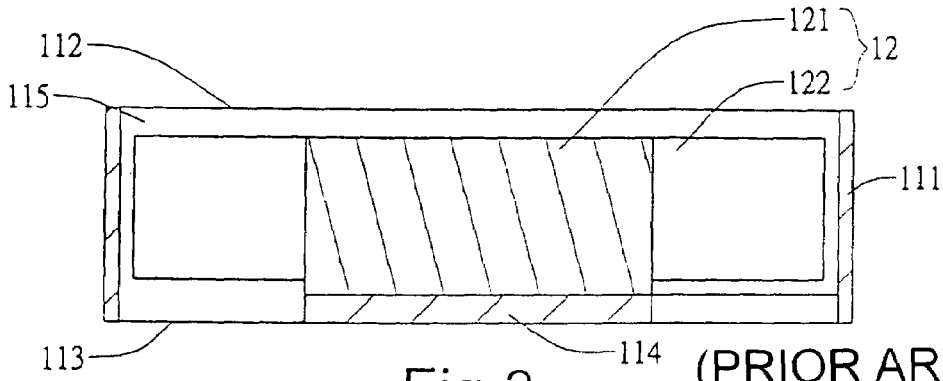
Fig 3 (PRIOR ART)
FIG. 3 is a sectional view of the conventional fan assembly shown in FIG. 2.
Figure 4:
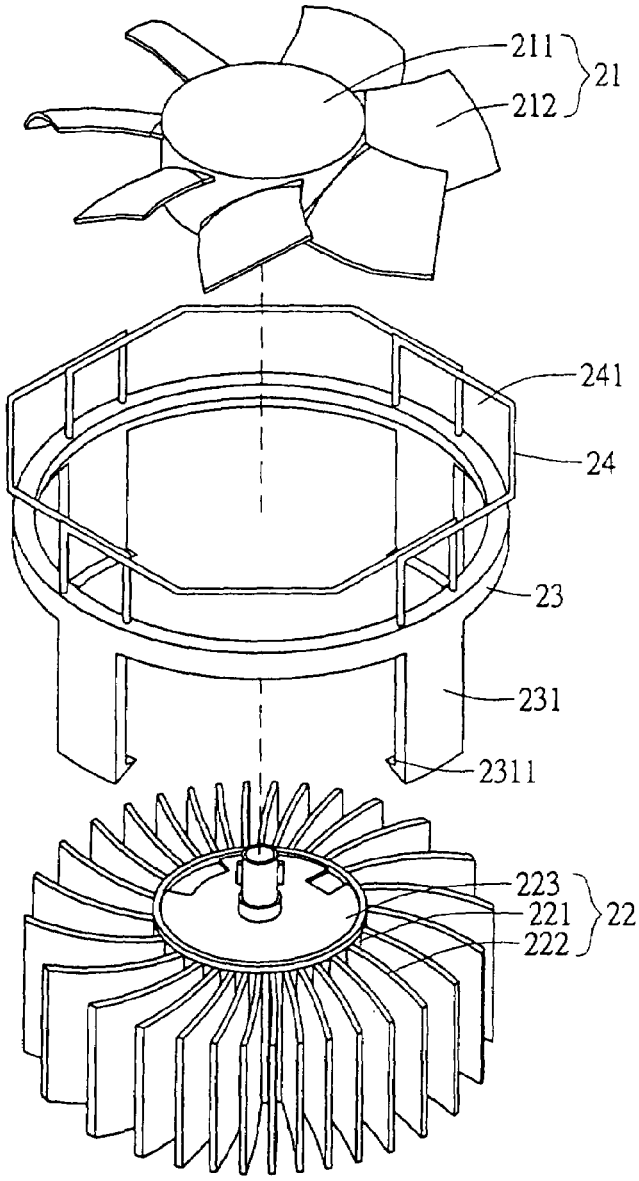
FIG. 4 is a disassembled perspective view of a first embodiment of a fan device with a radiation according to the present invention in the first embodiment thereof.
Figure 5:
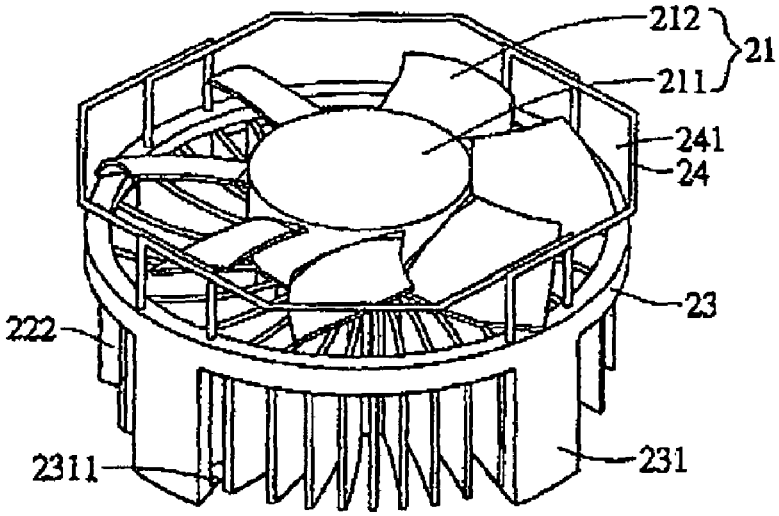
FIG. 5 is an assembled perspective view of the fan device with a radiator shown in FIG. 4.

Referring to FIGS. 4 and 5, the first embodiment of a fan device with a radiator according to the present invention at least includes a fan frame 23 with a guard bar device 24, a fan wheel 21 and a radiator 22. The fan wheel 21 further includes a hub 211 and a plurality of fan blades 212 extending outward from circumference of the hub 211 in a radial direction respectively. The radiator 22 is circular and further includes a cylindrical body 221 and a plurality of cooling fins 222 extending outward from the cylindrical body 221 radially to form a cylindrical shape. A fan base 223 with a shaft is provided on the cylindrical body 221 being rotationally attached with the fan wheel 21. The frame 23 is annular with four fixing parts 231, which equally space from each other, extending downward and each of the fixing parts 231 has an elongated plate shape with an inward hook end 2311 to hold the bottom of the radiator 22. The guard bar device 24 is disposed on top of the frame 23 and composed of four bent bar sections with two ends of the respective bar section extending downward to be fixedly attached to the frame 23. The bar sections are arranged in a manner of the end portions of the bar sections overlapping to each other such that the fan wheel 21 is surrounded by the guard bar device 24 with a plurality of openings 241 admitting fluid to enter the radiator while the fan wheel 21 running.

When the fan device with a radiator is set up, the frame 23 embraces the radiator 22 with the inversed hook ends 2311 holding the lower side of the radiator 22 and the guard device 24 surrounds the fan wheel 21 over the radiator 22.

Figure 6:
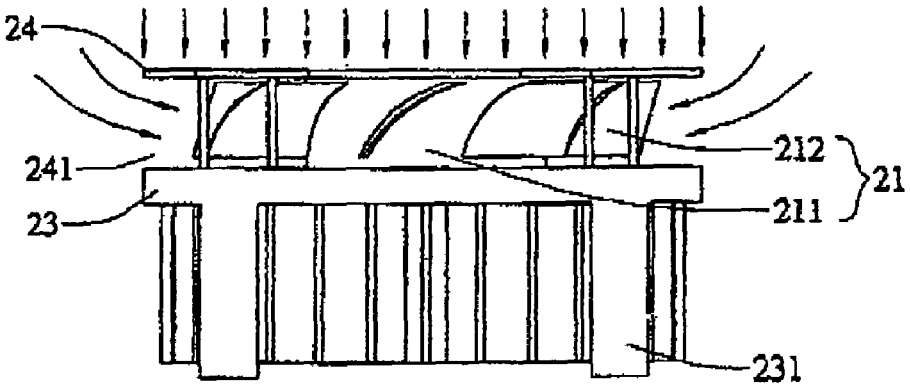
FIG. 6 is a sectional view of the fan device with a radiator shown in FIG. 5 illustrating operation thereof.

Referring to FIG. 6 in company with FIG. 4 again, when the fan wheel 21 rotates to drive fluid entering the radiator 22 via the upper part of the space enclosed by the guard bar device 24 and the lateral side of the guide device 24 via the openings 241. In this way, the incoming flow rate of the fluid increases to enhance efficiency of heat dissipation. Further, due to the guard bar device 24 being composed of bent bar sections instead of the conventional fan frame wall, deficiency of the fluid frictionally hitting the fan frame wall during the fan wheel 21 rotating is overcome such that it is able to attenuate noise tremendously. Further, the guard bar device 24 prevents foreign objects from entering the fan wheel 21 as well.

Figure 7:
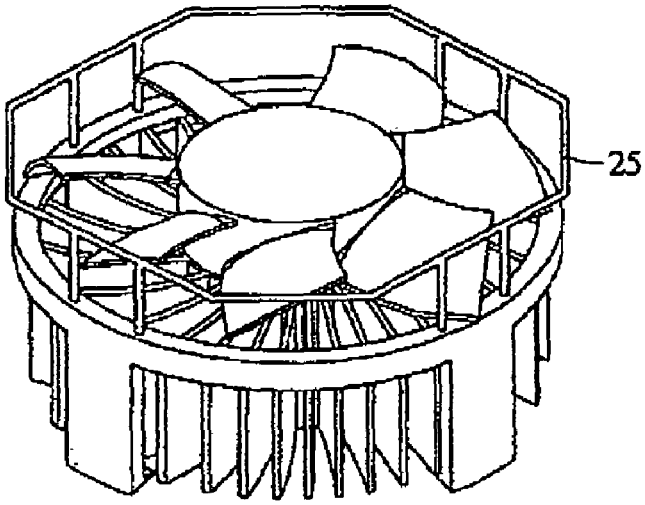
FIG. 7 is another perspective view similar to FIG. 5 illustrating another guard device.

Referring to FIG. 7, the guard device 25 is an octagon bar with a plurality of connecting rods extending downward to fixedly join the frame instead of the guard device 24 shown in FIG. 5.

Figure 8:
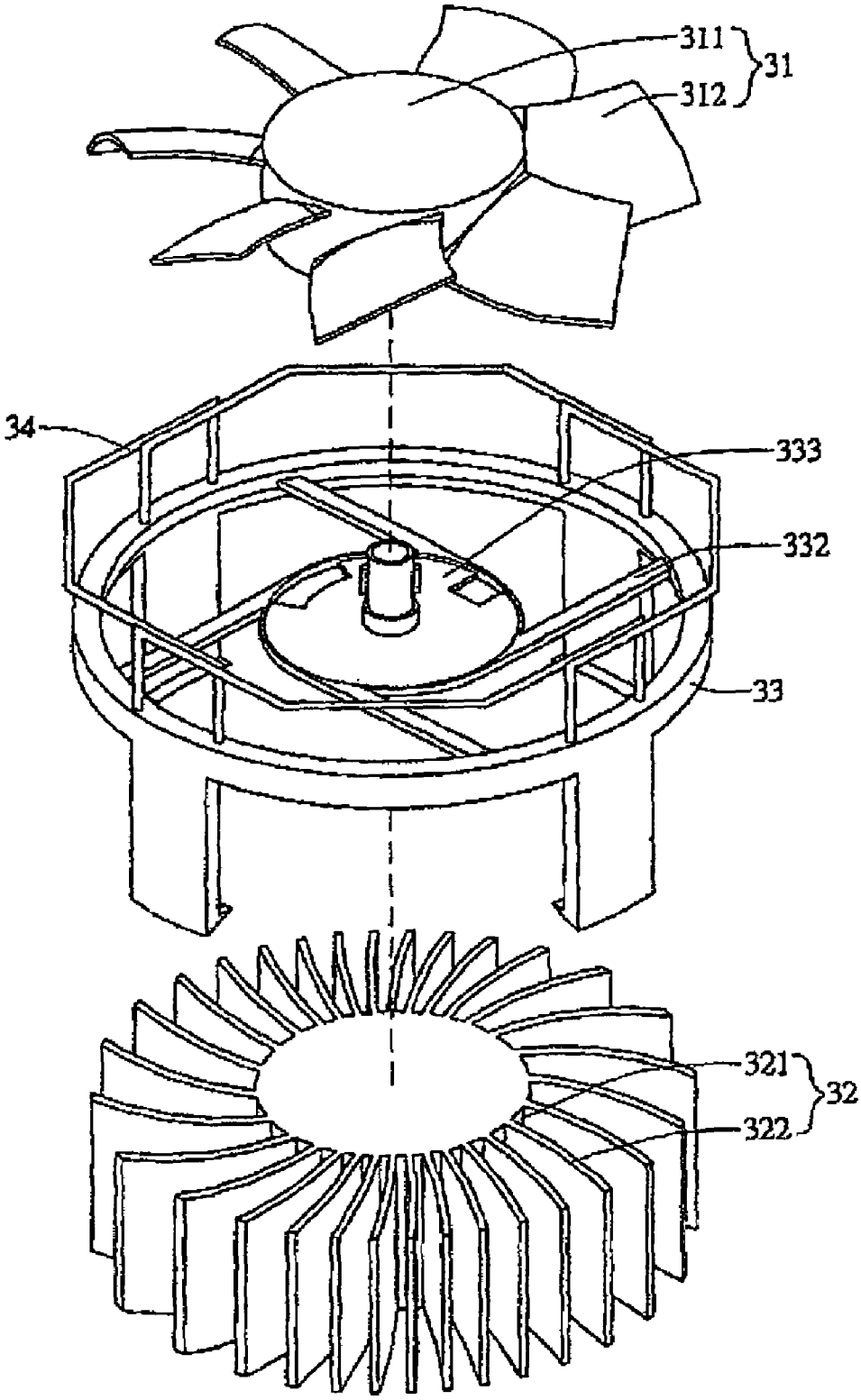
FIG. 8 is a disassembled perspective view of the second embodiment of a fan device with a radiator according to the present invention.
Figure 9:
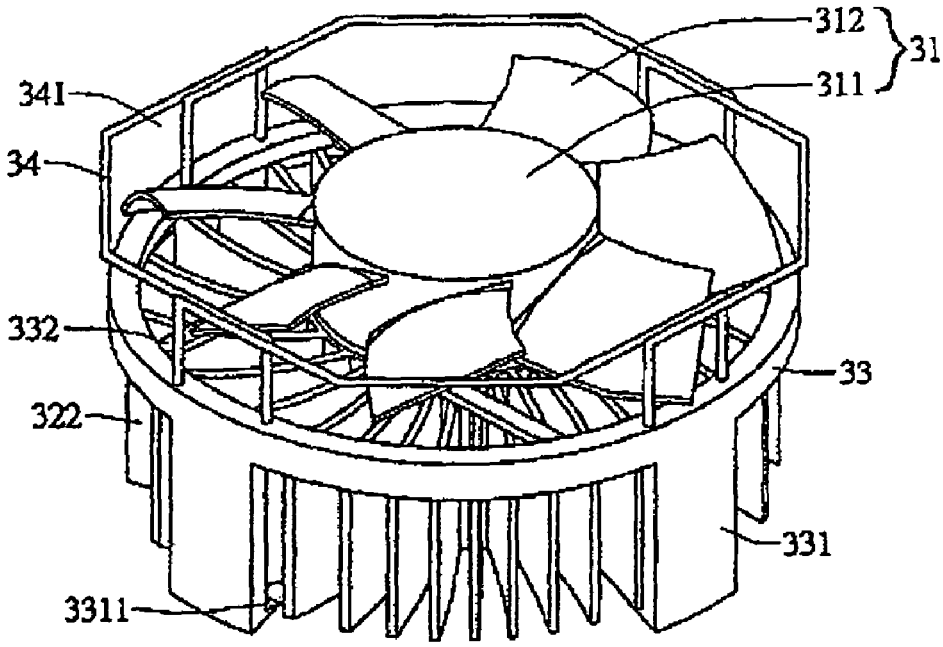
FIG. 9 is an assembled perspective view of the fan device with a radiator shown in FIG. 8.

Referring to FIGS. 8 and 9, the second embodiment of the present invention is illustrated. A fan device with a radiator of the second embodiment is similar to the first embodiment and provides a fan wheel 31 with a hub 311 and a plurality of fan blades 312, a frame 33 with a guard device 34 and a radiator 32 with a plurality of cooling fins 322 and a cylindrical body 321. The difference of the second embodiment from the first embodiment is in that a fan base 333 is held to the frame 33 with support bars 332 instead of the fan base 223 being joined to the radiator 22 shown in FIG. 5.

Figure 10:
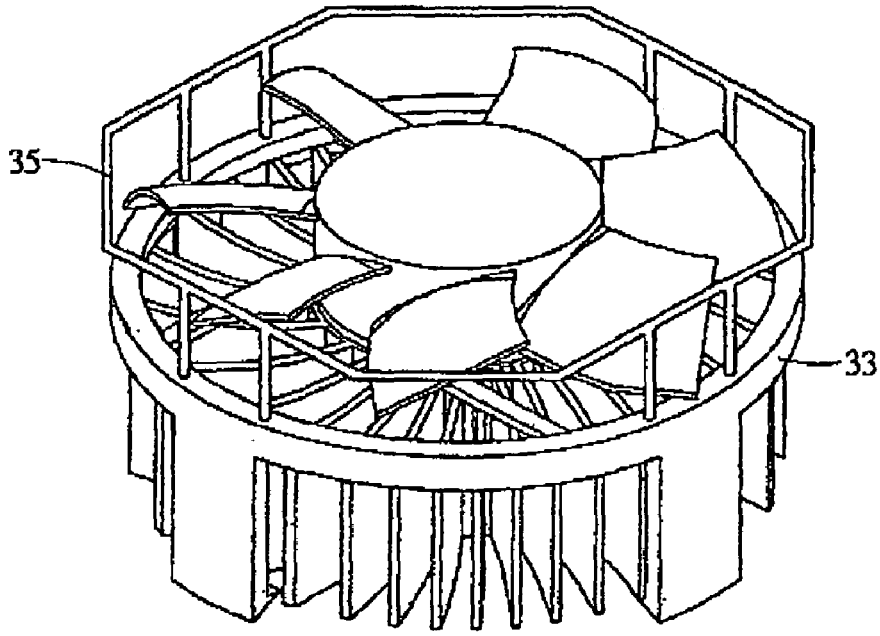
FIG. 10 is a perspective view similar to FIG. 9 illustrating another guard device.

Referring to FIG. 10, the guard device 35 is a octagon bar with a plurality of connecting rods joined to the frame 33 instead of the guard bar device 34 shown in FIG. 9.

Figure 11:
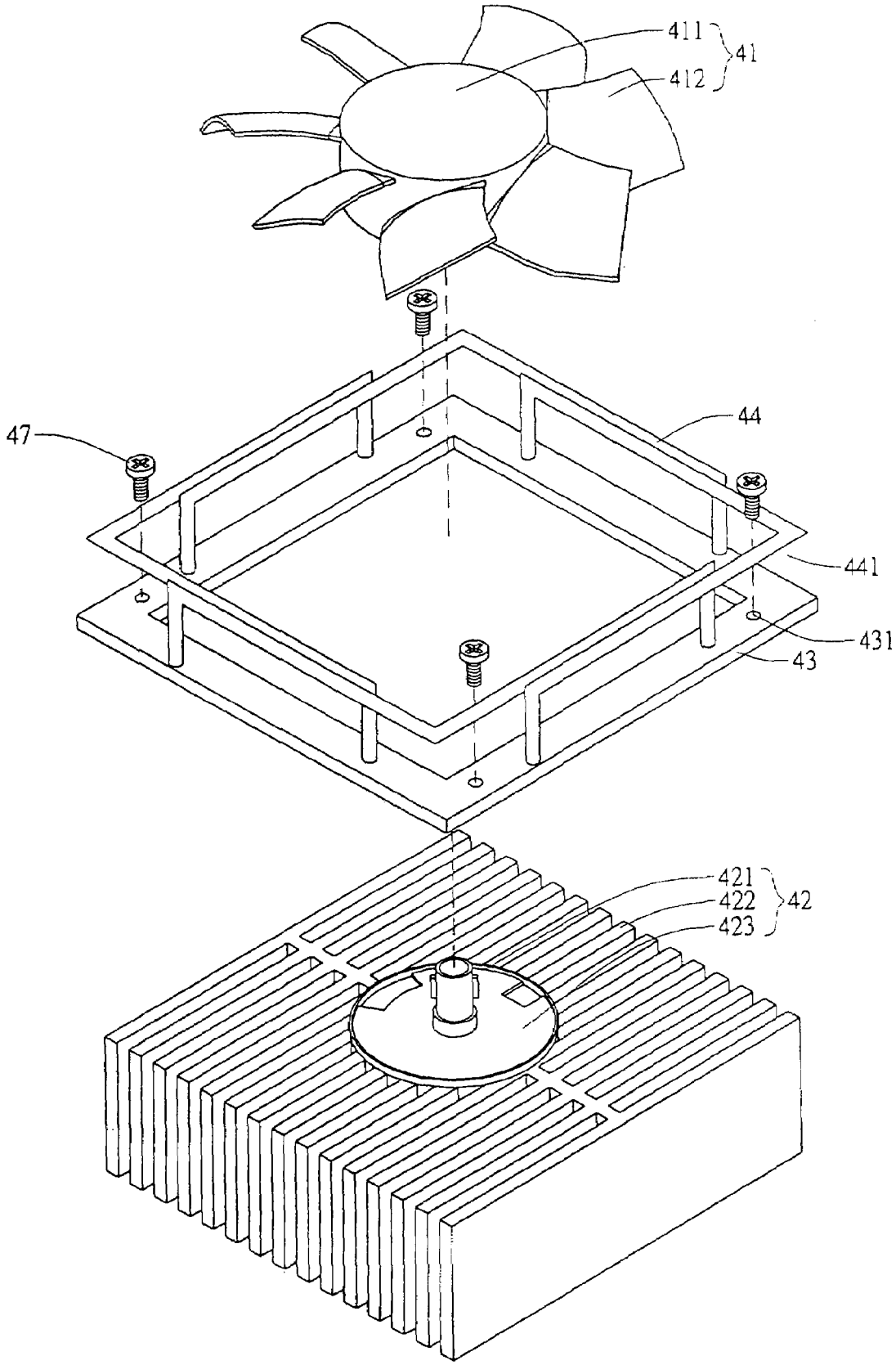
FIG. 11 is a disassembled perspective view of the third embodiment of a fan device with a radiator according to the present invention.
Figure 12:
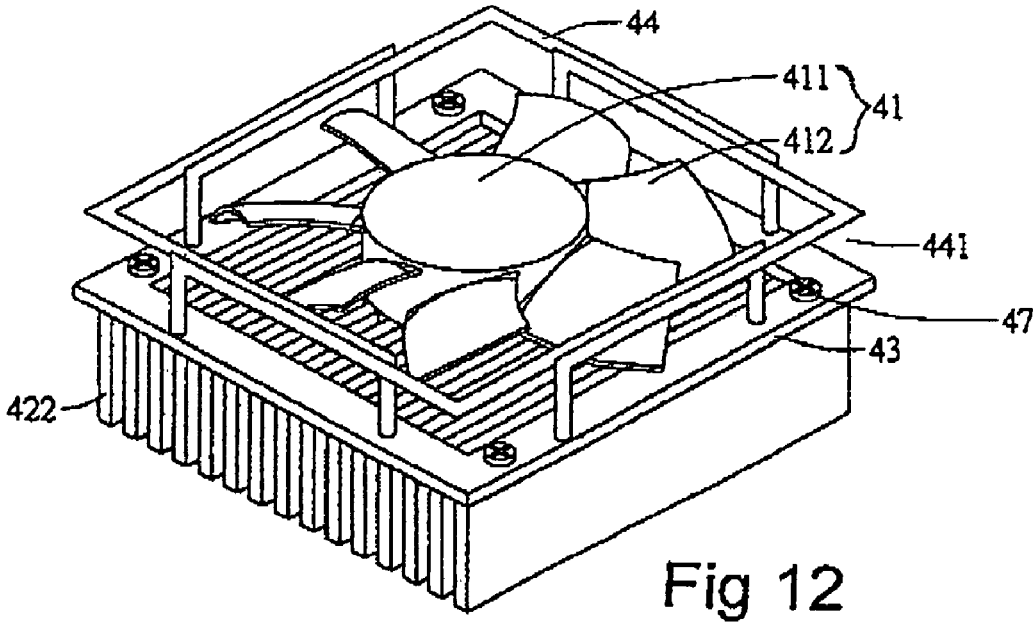
FIG. 12 is an assembled perspective view of the fan device with a radiator shown in FIG. 11.

Referring to FIGS. 11 and 12, the third embodiment of the present invention is illustrated. A fan device with a radiator of the third embodiment of the present invention provides a fan wheel 41 with a hub 411 and a plurality of fan blades 412, a quadrilateral frame 43 with a guard bar device 44 and a quadrilateral radiator 2 with a plurality of rectangular cooling fins 322 and a cylindrical body 421. The radiator 42 further has a fan base 423 fixedly attached to the central position of the top of the radiator 42. The frame 43 is corresponding to the radiator 42 and has a plurality of fixing holes 431 for being passed through with a fastener 47 respectively such that the frame 43 can be attached to the radiator 42. The guard bar device 44 is composed of four angle bars with both ends of the respective angle bar extending downward to fixedly join the frame 43 in a manner of the angle bars being disposed to overlap with each other consecutively except the right angle portions thereof such that the fan wheel 41 is surrounded by the angle bars with a plurality of openings 411 between the guard bar device 44 and the frame 43.

Figure 13:
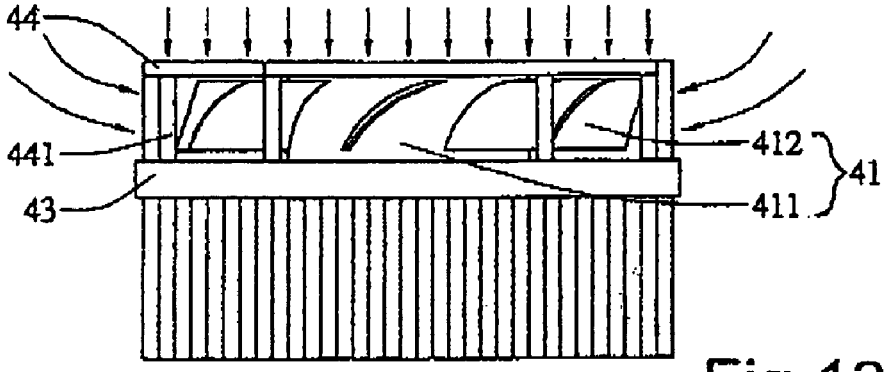
FIG. 13 is a side view of the fan device with a radiator shown in FIG. 12 illustrating operation thereof.

Referring to FIG. 13 in company with FIG. 12 again, when the fan wheel 41 rotates to drive fluid entering the radiator 42 via the upper part of the space enclosed by the guard device 44 and the lateral side of the guard bar device 44 via the openings 441. In this way, the incoming flow rate of the fluid increases to enhance efficiency of heat dissipation. Further, due to the guard bar device 44 being composed of four angle bars instead of the conventional fan frame wall, deficiency of the fluid frictionally hitting the fan frame wall during the fan wheel 41 rotating is overcome such that it is able to attenuate noise tremendously. Further, the guard bar device 44 prevents foreign objects from entering the fan wheel 41 as well.

Figure 14:
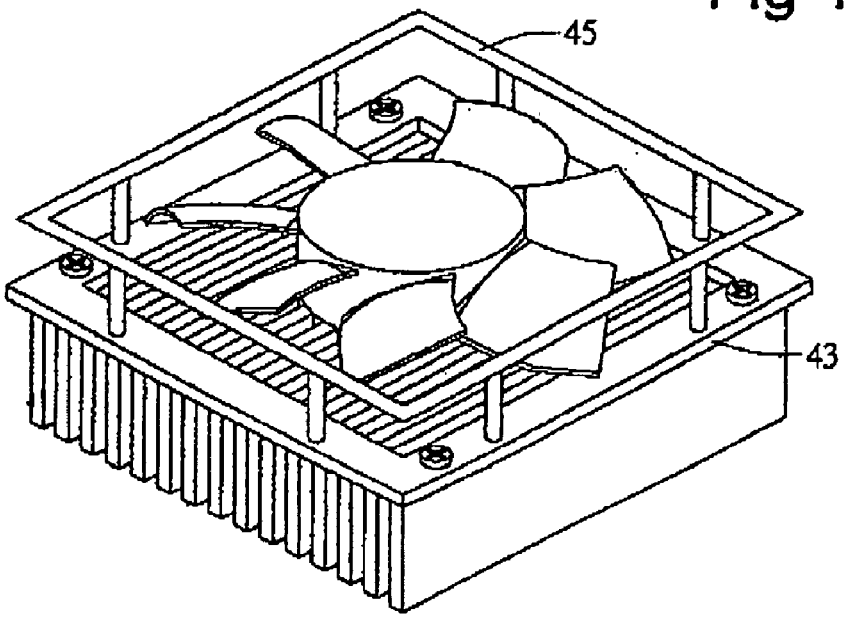
FIG. 14 is a perspective view similar to FIG. 12 illustrating another guard device.

Referring to FIG. 14, the guard bar device 45 is a quadrilateral bar with a plurality of connecting rods extending downward to fixedly join the frame 43 instead of the guard device 44 shown in FIG. 12.

Figure 15:
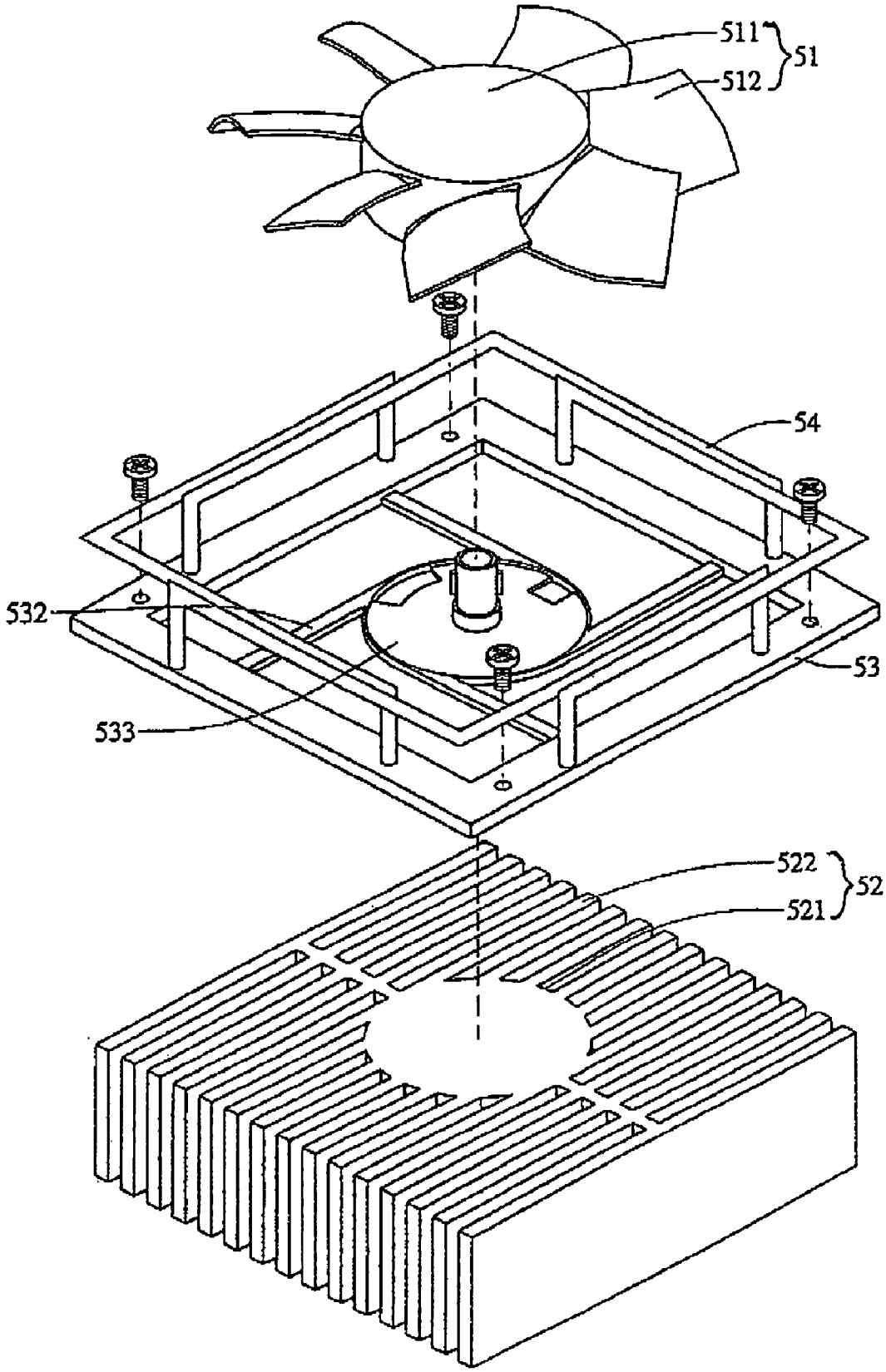
FIG. 15 a disassembled perspective view of the fourth embodiment of a fan device with a radiator according to the present invention.
Figure 16:
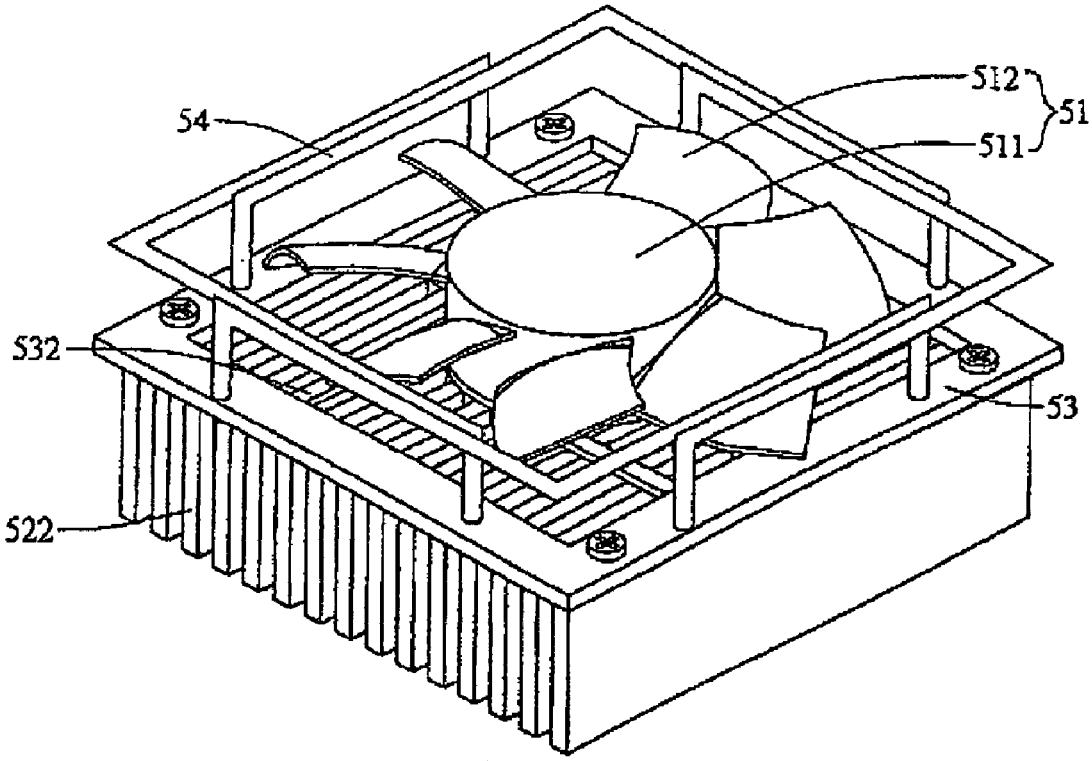
FIG. 16 is an assembled perspective view of the fan device with a radiator shown in FIG. 15.

Referring to FIGS. 15 and 16, the fourth embodiment of the present invention is illustrated. A fan device with a radiator of the fourth embodiment is similar to the third embodiment and provides a fan wheel 51 with a hub 511 and a plurality of fan blades 512, a frame 53 with a guard device 54 and a radiator 52 with a plurality of cooling fins 522 and a cylindrical body 521. The difference of the fourth embodiment from the third embodiment is in that a fan base 533 is held to the frame 33 with support bars 532 instead of the fan base 423 being joined to the radiator 42 shown in FIG. 11.

Figure 17:
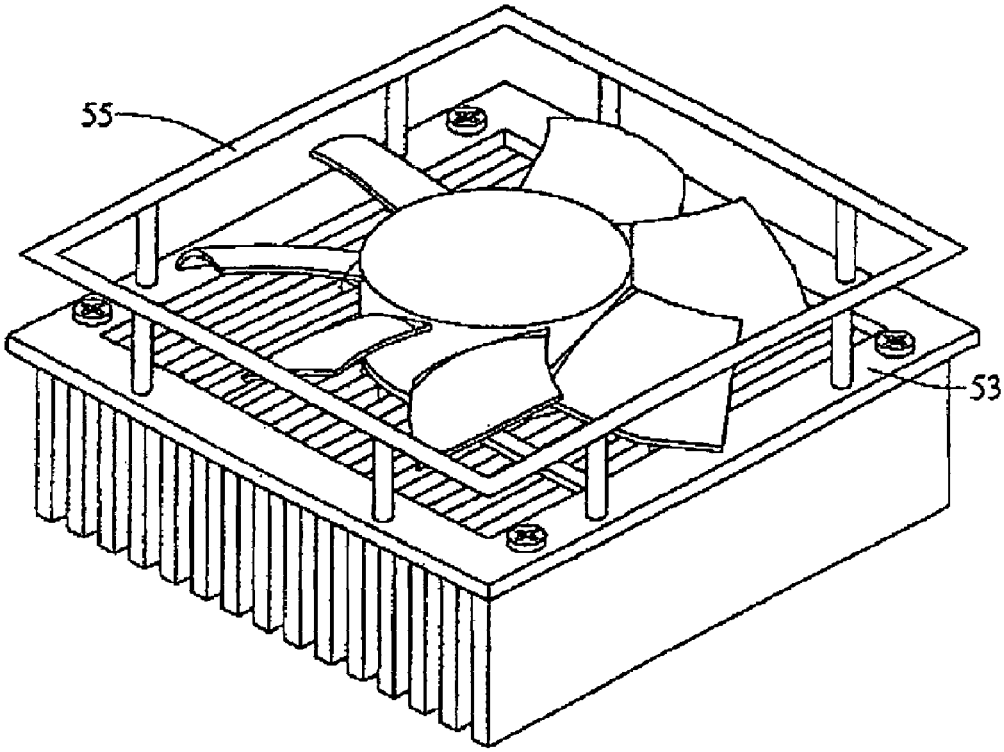
FIG. 17 is a perspective view similar to FIG. 16 illustrating another guard device.

Referring to FIG. 17, the guard device 55 is a quadrilateral bar with a plurality of connecting rods extending downward to fixedly join the frame 53 instead of the guard bar device 54 shown in FIG. 16.

It is noted that the frame (23, 33, 43, 53) and the guard device (24, 25, 34, 35, 44, 45, 54, 55) illustrated in all the preceding embodiments can be integrally formed with the frame as a single piece instead.

In addition, the guard device (24, 25, 34, 44, 45, 54, 55) can be made of plastics instead of metal.

While the invention has been described with reference to preferred embodiments, it is to be understood that modifications and variations may be easily made without departing from the spirit of this invention defined by the appended claims.

What is claimed is:

1. A fan device with a radiator, comprising:

a cylindrical radiator, providing a cylindrical body at the center thereof with a plurality of cooling fins extending radially from the cylindrical body;

a ring shaped fan frame, being disposed at the top of the radiator;

a fan base with a shaft, being disposed at the top of the cylindrical body and the center of the frame; and a fan wheel with a hub, being rotationally attached to the shaft of the fan base and disposed above the fan frame;

characterized in that four fixing parts, which space from each other with an equal circular distance, extends downward from the frame to embrace the cylindrical radiator and each of the fixing parts has an elongated plate shape and an inward hook at the lower end thereof to hold the bottom side of the radiator; and an octagon guard bar device is disposed on top of the frame with a plurality of openings between the guard bar device and the frame to surround the fan wheel.

2. The fan device with a radiator as defined in claim 1, wherein the guard bar device is composed of four bent bar sections with two ends of the respective bar section extending downward to fixedly join the frame such that the bar sections are disposed to connect with each other in a manner of end portions end thereof overlapping to each other consecutively.

3. The fan device with a radiator as defined in claim 1, wherein the guard bar device is a single piece of octagon bar with a plurality of connecting rods extending downward from the bar to fixedly join the frame.

4. A fan device with a radiator, comprising:

a square radiator, having a cylindrical body at the center thereof;

a square fan frame, being detachably joined to the four sides of the top of the radiator;

a fan base with a shaft, being disposed at the top of the cylindrical body; and a fan wheel with a hub, being rotationally attached to the shaft of the fan base and disposed above the fan frame;

characterized in that a square guard bar device with a plurality openings between the frame and the guard device is disposed on top of the fan frame to surround the fan wheel.

5. The fan device with a radiator as defined in claim 4, wherein the guard bar device is composed of four angle bar sections and each of the angle bar sections has a right angle portion with both ends of the respective angle bar section extending downward to fixedly join the frame; and the angle bar sections connect with each other in a manner of the respective angle bar section overlapping with each other consecutively except the right angle portion.

6. The fan device with a radiator as defined in claim 4, wherein the guard bar device is a single piece of bar with a plurality of connecting rods extending downward from the bar to fixedly join the frame.

* * * * *